US005368407A

United States Patent [19]

Law

[11] Patent Number: 5,368,407

[45] Date of Patent: Nov. 29, 1994

[54] RING BINDER CARRIER RAILS

[75] Inventor: Chun C. Law, Hong Kong, Hong Kong

[73] Assignee: World Wide Stationery Manufacturing Co., Ltd., New Territories, Hong Kong

[21] Appl. No.: 55,968

[22] Filed: Apr. 30, 1993

[51] Int. Cl.[5] ..... B42F 13/16
[52] U.S. Cl. ..... 402/36
[58] Field of Search ..... 402/29, 31, 36–39

[56] References Cited

FOREIGN PATENT DOCUMENTS 2209800 5/1989 United Kingdom ..... 402/75
2255529A 11/1992 United Kingdom .

*Primary Examiner*—P. W. Echols
*Attorney, Agent, or Firm*—Heller, Ehrman, White & McAuliffe

[57] ABSTRACT

A carrier rail for a ring binder is formed with a deformation around each point where the ring member is to be attached to the rail, the deformation being in the form of a circular rib.

7 Claims, 2 Drawing Sheets

RING BINDER CARRIER RAILS

This invention relates to ring binders to hold paper and the like for loose-leaf binders, files, folders and the like.

During the manufacture of prior art ring binders, a problem has been ascertained, namely that when the ring member is attached to the carrier rail of a ring binder, deformation of the rail around the base of the ring member is formed, causing slight bending of the whole rail itself.

It is an object of this invention to overcome this problem.

In accordance with the invention, a carrier rail for a ring binder is pre-formed with a deformation around each point where a ring member is to be attached to the rail.

Suitably the deformation is in the form of a circular rib, and the end of each ring member is power pressed onto the rail within this circular rib so that no unnecessary deformation of the rail outside the circular rib is achieved.

The advantage of the invention is that in the prior art, deformation of the rail has led to 50% wastage during assembly, due to the fact that as the rails are slightly bent, such causes the ring binder to be difficult to assemble.

A further problem with a bent rail is that during assembly of the ring binder, it is difficult to crimp the sides of a housing member around the edges of a bent rail.

Suitably the rail is provided with at least one insertion hole into which the ring member is secured, wherein the insertion hole is surrounded by the deformation.

Preferably a longitudinal rib is provided, which extends between two insertion holes.

The provision of a rib in the rail provides stiffness thereto, which is required since holes in the rail weaken the integrity thereof.

The invention will now be described by way of example with reference to the accompanying drawings in which.

Figure 1:
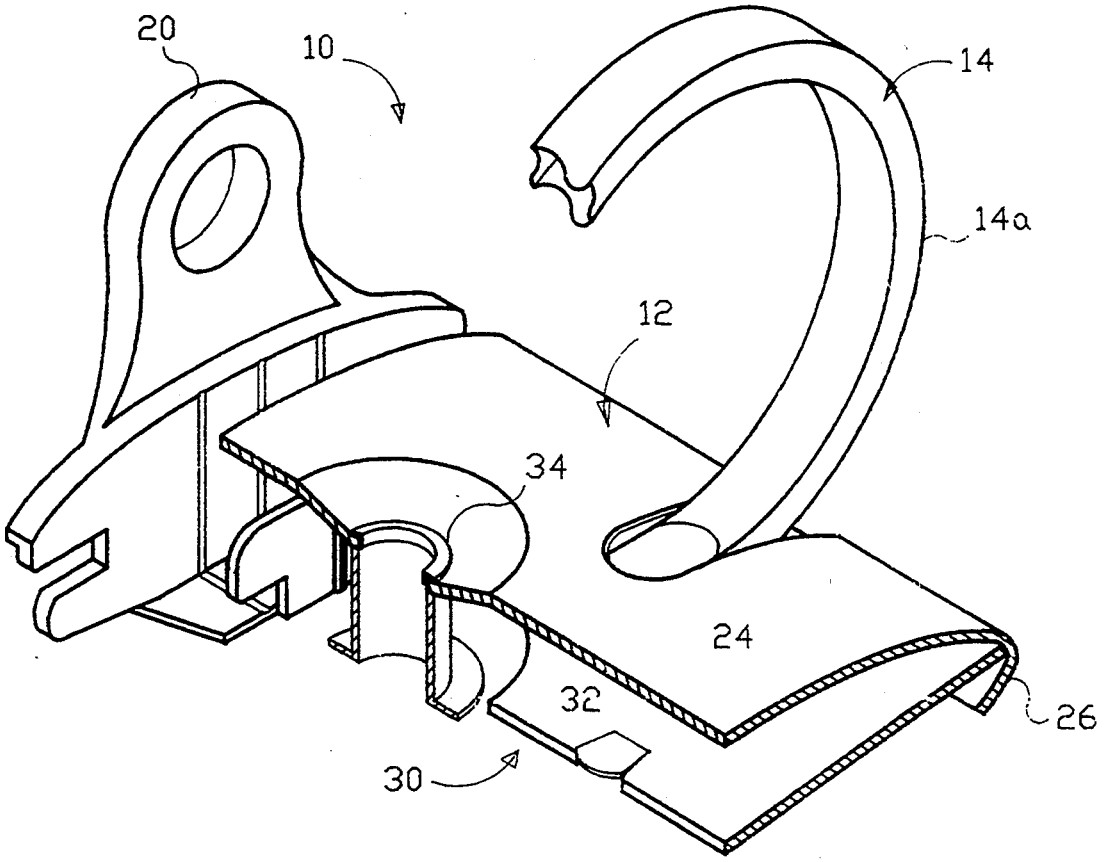
FIG. 1 shows a perspective view of a ring binder in accordance with the invention.

In FIG. 1 a ring binder 10 is shown for a loose-leaf binder comprising a base member 12, three ring members 14 spaced along the base member (only one of which is shown in FIG. 1), and an opening and closing mechanism 20 at each end of the base member (again only one of which is shown in FIG. 1). The base member 12 comprises a housing member in the form of an upper rigid structure 24 which is curved in cross-section and which supports between its two overlapping sides 26 a pivotable lower structure 30 comprising two carrier rails 32 pivotable to each other along the longitudinal axis of the binder 10.

The ring members 14 are mounted on the pivotable lower structure 30 and in particular, one of the ring components (i.e., component 14*a*) of each ring member is mounted on the carrier rail 32 while the other ring component (not shown) of each ring member is mounted on the other carrier rail (also not shown).

Fastening means 34, meanwhile, are also provided on the upper structure 24 in order to secure the ring binder 10 to a paper folder or the like.

The two carrier rails 32 are movable (i.e., pivoted) relative to each other between a lower position and an upper position due to the action of the opening and closing mechanism 20 on each end of the carrier rails.

The opening and closing mechanism 20 is pivotably supported on each end of the upper rigid structure 24 and is in engagement with each end of the pivotable lower structure 30 in order to position the opening and closing mechanism 20 between the upper and lower structures.

Figure 2:
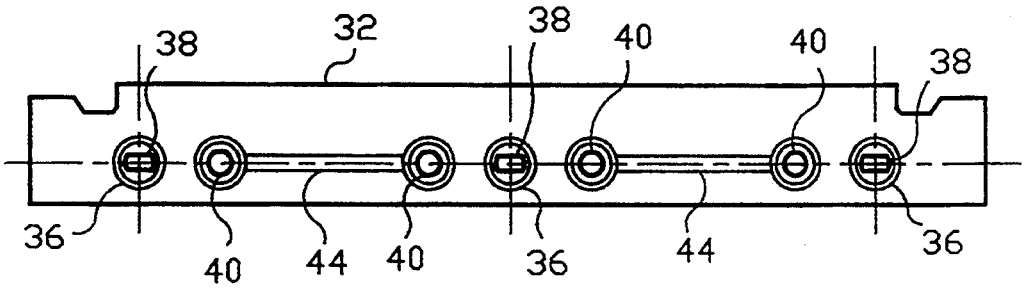
FIG. 2 shows a carrier rail used in the ring binder of FIG. 1.

The carrier rail 32 is shown in greater detail in FIG. 2, and is shown provided with a pre-formed deformation in the form of a circular rib 36 surrounding each hole 38 in the rail, to which hole 38 the end of a ring member is power pressed in order to connect the end of the ring member to the carrier rail. The provision of circular ribs 36 keeps deformation of the rail 32 near the ring hole 38 within a confined area (i.e., within the circular rib 36), such that the area outside the circular rib 36 is unaffected and remains completely straight.

The rail is also provided with a number of guide holes 40 which are used to guide the rail 32 to the power press for connecting the ring members 14 to the rail.

Figure 3:
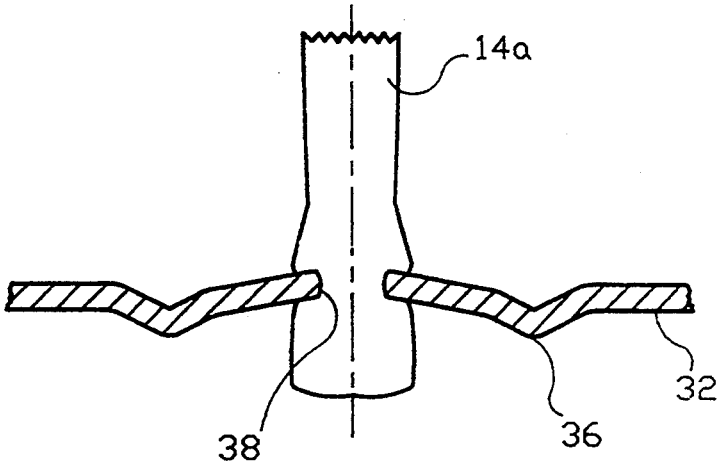
FIG. 3 shows a cross-sectional view of a ring member connected to the carrier rail shown in FIG. 2.

As will be seen from FIG. 3, the inner end of the ring is secured to the rail through the rail hole 38, and the circular rib 36 around the rail hole 38 prevents any deformation of the rest of the rail 32 outside the circular rib 36.

Advantageously, such leads to easy assembly since the rail is not bent, and saves upto 50% wastage of rails which occurs in prior art assembly processes.

Prevention of bending in the rail also makes insertion of rails within the housing member, and crimping of the sides of the housing member about the edges of the rail much easier during assembly of the ring binder, simply for the fact that the rails fit properly in the housing member.

A further advantage of the rail not being bent is that when two rails are pivotably joined during assembly of the ring binder, there is easy and quick matching of the two rails, since the two rails are perfectly straight.

The guides holes 40 are also provided with circular ribs therearound, and longitudinal ribs 44 are provided between the holes 40 in order to strengthen the rail 32.

The ribs 44 are needed in light of the fact that there are seven holes 38 and 40 in total on the rail, and such reduces the overall rail stiffness, and the two ribs 44 between the four holes 40 overcome this problem. The ribs 44 also aid to prevent the rail 32 from bending when the ring members 14 are secured to the ring holes 38.

The reduction of rail stiffness also weakens the opening force of the ring binder 10. Providing the ribs 44 between the four holes 40 also overcomes this problem. In particular, by the provision of ribs 44 on the rail, the rail 32 provides an increased opening force for the ring binder of 8 to 9% over the prior art.

As mentioned above, prior art rails have been 50% wasted, which compares with use of the rail in accordance with the present invention where there is no wastage whatsoever.

The whole content of the two co-pending U.S. Pat. application Ser. No. 08/055,967 and co-pending U.S. Pat. application Ser. No. 08/056,300, filed on the same day as this case by the same applicant are incorporated into this case by reference thereto.

I claim:

1. A preformed carrier rail for a ring binder comprising at least one insertion hole into which a ring member is secured, and a deformation around the insertion hole.

2. A rail as claimed in claim 1 wherein the deformation is in the form of a circular rib.

3. A rail as claimed in claim 2 wherein a longitudinal rib is provided and wherein the rib extends between two insertion holes.

4. A rail as claimed in claim 1 wherein the insertion hole is surrounded by the deformation.

5. A rail as claimed in claim 1 wherein a longitudinal rib is provided.

6. A rail as claimed in claim 1 wherein a longitudinal rib is provided and wherein the rib extends between two insertion holes.

7. A ring binder formed using a rail as claimed in claim 1.

* * * * *